US008146665B2

(12) United States Patent
Neal

(10) Patent No.: US 8,146,665 B2
(45) Date of Patent: Apr. 3, 2012

(54) APPARATUS AND METHOD FOR MAINTAINING BOOST PRESSURE TO HIGH-PRESSURE PUMPS DURING WELLBORE SERVICING OPERATIONS

(75) Inventor: Kenneth Neal, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 1176 days.

(21) Appl. No.: 11/939,400

(22) Filed: Nov. 13, 2007

(65) Prior Publication Data

US 2009/0120635 A1 May 14, 2009

(51) Int. Cl.
*E21B 43/26* (2006.01)

(52) U.S. Cl. ..... 166/305.1; 166/90.1; 166/250.01

(58) Field of Classification Search ..... 166/305.1, 166/90.1, 250.01; 507/202; 417/53
See application file for complete search history.

(56) References Cited

U.S. PATENT DOCUMENTS

| | | | | |
|---|---|---|---|---|
| 4,212,354 | A * | 7/1980 | Guinn | 166/303 |
| 4,953,618 | A * | 9/1990 | Hamid et al. | 166/250.01 |
| 5,318,382 | A * | 6/1994 | Cahill | 405/129.4 |
| 5,346,012 | A | 9/1994 | Heathman et al. | |
| 5,588,488 | A | 12/1996 | Vijn et al. | |
| 5,913,364 | A | 6/1999 | Sweatman | |
| 6,167,967 | B1 | 1/2001 | Sweatman | |
| 6,258,757 | B1 | 7/2001 | Sweatman et al. | |
| 7,051,818 | B2 * | 5/2006 | Crawford et al. | 166/379 |
| 2007/0151454 | A1 * | 7/2007 | Marwitz et al. | 96/7 |
| 2011/0272158 | A1 * | 11/2011 | Neal | 166/305.1 |

OTHER PUBLICATIONS

Schlumberger, Oilfield Glossary: Term "hydraulic fracturing", http://www.glossary.oilfield.slb.com/Display.cfm?Term=hydraulic%20fracturing, 2007 Schlumberger Limited, Nov. 13, 2007, 1 pg.

* cited by examiner

*Primary Examiner* — David Bagnell
*Assistant Examiner* — Richard Alker
(74) *Attorney, Agent, or Firm* — John W. Wustenberg; Conley Rose, P.C.

(57) ABSTRACT

A wellbore services manifold trailer comprising a blender connector configured to couple to a blender, a boost pump coupled to the blender connector, a high-pressure pump suction connector coupled to the boost pump and configured to couple to a high-pressure pump, a high-pressure pump discharge connector configured to couple to the high-pressure pump, and a wellhead connector configured to couple to a wellhead is disclosed. A wellbore servicing method comprises receiving a fluid at a first pressure, increasing the pressure of the fluid to a second pressure greater than the first pressure, feeding the fluid to a high-pressure pump at the second pressure, receiving the fluid from the high-pressure pump at a third pressure greater than the second pressure, and feeding the fluid to a wellhead at the third pressure is also disclosed.

19 Claims, 3 Drawing Sheets

APPARATUS AND METHOD FOR MAINTAINING BOOST PRESSURE TO HIGH-PRESSURE PUMPS DURING WELLBORE SERVICING OPERATIONS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX

Not applicable

BACKGROUND

The present disclosure relates to wellbore servicing operations. More specifically, the present disclosure relates to a wellbore services manifold trailer and a method of using the same to maintain boost pressure to high-pressure pumps.

High-pressure pumps are used in many phases of wellbore servicing operations. Such pumps often suffer from cavitation, a condition affecting an operating pump whereby bubbles are formed in the fluid being pumped. Cavitation is typically caused by inadequate pump inlet pressure. Cavitation is an undesirable condition that causes a reduction in pump efficiency and excessive wear and damage to pump components. Thus, a need exists for an improved method for preventing cavitation in high-pressure pumps used in wellbore servicing operations.

SUMMARY

In one aspect, the disclosure includes a wellbore services manifold trailer comprising a blender connector configured to couple to a blender, a boost pump coupled to the blender connector, a high-pressure pump suction connector coupled to the boost pump and configured to couple to a high-pressure pump, a high-pressure pump discharge connector configured to couple to the high-pressure pump, and a wellhead connector configured to couple to a wellhead. In an embodiment, the boost pump is a centrifugal pump. In another embodiment, the high-pressure pump is a positive displacement pump. In yet another embodiment, the blender has an outlet pressure equal to or less than about 100 psi, the boost pump has an outlet pressure equal to or greater than about 60 psi, and the high-pressure pump has an outlet pressure equal to or greater than about 2,000 psi. In yet another embodiment, the wellbore services manifold trailer further comprises a bypass valve assembly coupled to the blender connector, the boost pump, and the high-pressure pump suction connector, wherein the bypass valve assembly is configured to allow fluid flow between the blender connector and the boost pump and prohibit fluid flow between the blender connector and the high-pressure pump suction connector in a first position. The bypass valve assembly may also be configured to allow fluid flow between the blender connector and the high-pressure pump suction connector and prohibit fluid flow between the blender connector and the boost pump in a second position. In an embodiment, the wellbore services manifold trailer further comprises a flowmeter coupled to the boost pump and the high-pressure pump suction connector, wherein the orientation of the flowmeter is substantially vertical. In another embodiment, the wellbore services manifold trailer further comprises a power source generating power for the boost pump. The wellbore services manifold trailer may further comprise a hydraulic control system coupled to the power source and the boost pump. The wellbore services manifold trailer may also comprise a plurality of lights powered by the power source. The blender may have an outlet pressure equal to or less than about 60 psi, the boost pump may have an outlet pressure equal to or greater than about 80 psi, and the high-pressure pump may have an outlet pressure equal to or greater than about 10,000 psi. The wellbore services manifold trailer may also comprise a vapor/liquid separator.

In another aspect, the disclosure includes a wellbore servicing method comprises receiving a fluid at a first pressure, increasing the pressure of the fluid to a second pressure greater than the first pressure, feeding the fluid to a high-pressure pump at the second pressure, receiving the fluid from the high-pressure pump at a third pressure greater than the second pressure, and feeding the fluid to a wellhead at the third pressure. In another embodiment, the wellbore servicing method further comprise generating power for a boost pump where the boost pump increases the pressure of the fluid to the second pressure, illuminating an area substantially adjacent to the wellbore services manifold trailer, generating power for a hydraulic control system, and controlling a flow rate or a pressure of a boost pump using the hydraulic control system. The wellbore servicing method may comprise measuring a fluid flow at the second pressure and adjusting a flow rate or a pressure of a boost pump based on the fluid flow where the boost pump increases the pressure of the fluid to the second pressure. The wellbore servicing method may substantially reduce or eliminate cavitation of the high-pressure pump. In an embodiment, the fluid comprises proppants, water, chemicals, or combinations thereof. In another embodiment, the fluid comprises liquefied carbon dioxide, liquefied nitrogen, or other liquefied inert gas.

In yet another aspect, the disclosure includes a wellbore servicing method comprises transporting a wellbore servicing manifold trailer to a well site to be serviced; powering on a power source, a boost pump, a hydraulic control system, and a plurality of lights; connecting a blender connector to a blender; connecting a high-pressure pump suction connector to a high-pressure pump; connecting a high-pressure pump discharge connector to the high-pressure pump; connecting a wellhead connector to a wellhead; adding a fluid to the blender; mixing the fluid; sending the fluid from the blender at a first pressure to the wellbore servicing manifold trailer; pressuring the fluid to a second pressure higher than the first pressure using the boost pump; controlling a flow rate or a pressure of the boost pump using the hydraulic control system; measuring a fluid flow at the second pressure; adjusting the flow rate or the pressure of the boost pump based on the fluid flow; sending the fluid from the wellbore servicing manifold trailer to the high-pressure pump; pressuring the fluid to a third pressure higher than the second pressure using the high-pressure pump; sending the fluid from the high-pressure pump to the wellbore servicing manifold trailer; and sending the fluid from the wellbore servicing manifold trailer to the wellhead at the third pressure.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
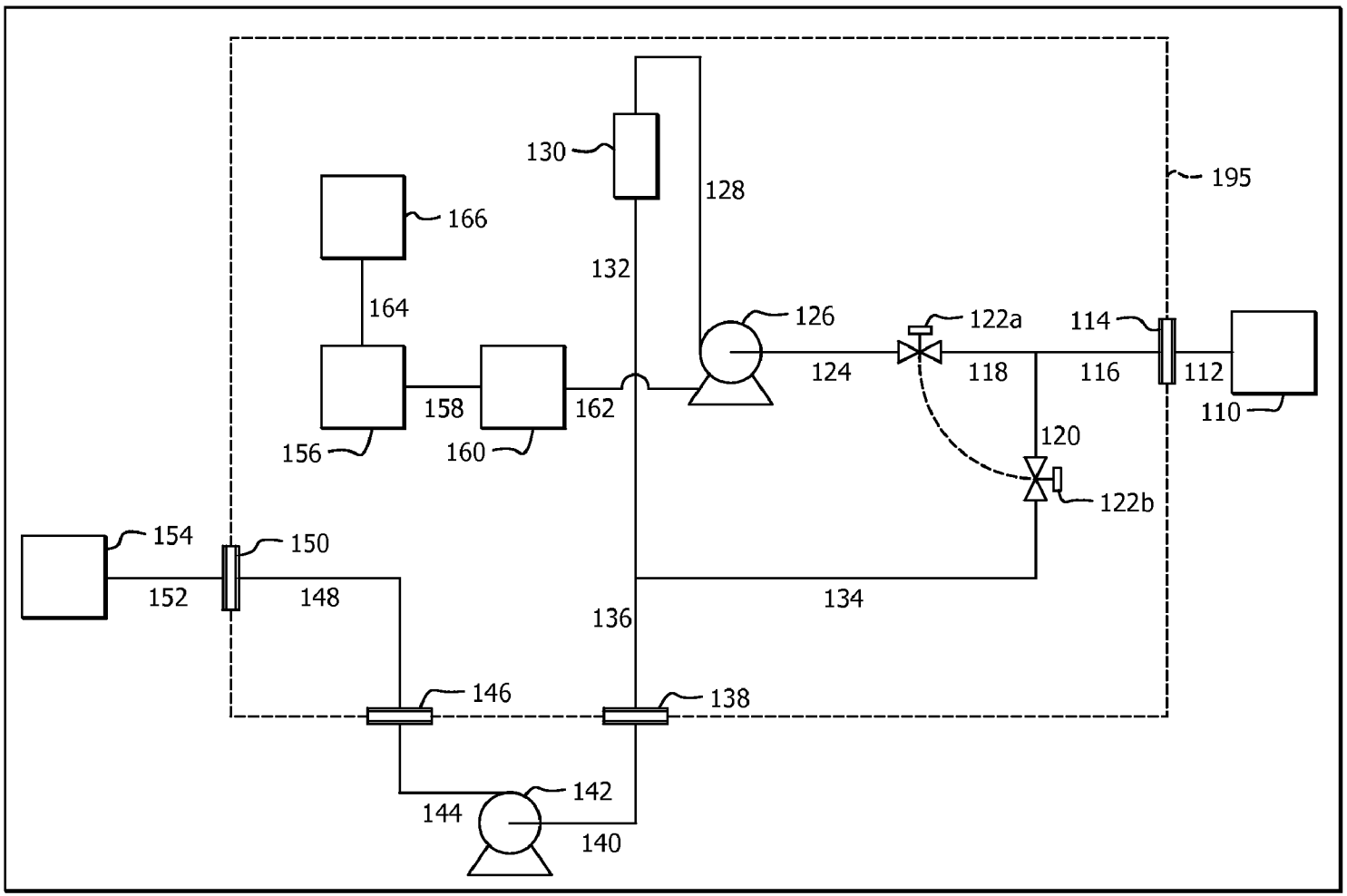
FIG. 1 is a schematic view of one embodiment of components associated with a wellbore services manifold trailer.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein are apparatus and method for maintaining boost pressure to high-pressure pumps during a wellbore servicing operation. In an embodiment, a wellbore servicing operation utilizes at least one wellbore services manifold trailer, one or more blenders, one or more high-pressure pumps, and one or more wellheads. The wellbore services manifold trailer may contain one or more boost pumps that boost the inlet pressure to the high-pressure pumps. The wellbore services manifold trailer may also include a flowmeter, a power source, and a hydraulic control system to power and control the boost pump. In an embodiment, the wellbore services manifold trailer may be used to reduce or eliminate cavitation of the high-pressure pumps caused by insufficient pressure of fluid supplied to the high-pressure pumps, thereby increasing the efficiency of the wellbore servicing operation and extending the life of the high-pressure pumps.

As used herein, the term "wellbore services manifold trailer" includes a truck and/or trailer comprising one or more manifolds for receiving, organizing, and/or distributing wellbore servicing fluids during wellbore servicing operations. Examples of such wellbore servicing operations include fracturing operations, acidizing operations, cementing operations, enhanced oil recovery operations and carbon dioxide injection operations. Fracturing operations are treatments performed on wells in low-permeability reservoirs. Fluids are pumped at high-pressure into the low-permeability reservoir interval to be treated, causing a vertical fracture to open in a formation. The wings of the fracture extend away from the wellbore in opposing directions according to the natural stresses within the formation. Proppants, such as grains of sand, are mixed with the fluid to keep the fracture open when the treatment is complete. Hydraulic fracturing creates high-conductivity communication with a large area of formation and bypasses any damage that may exist in the near-wellbore area. Cementing operations includes cementing an annulus after a casing string has been run, cementing a lost circulation zone, cementing a void or a crack in a conduit, cementing a void or a crack in a cement sheath disposed in an annulus of a wellbore, cementing an opening between the cement sheath and the conduit, cementing an existing well from which to push off with directional tools, cementing a well so that it may be abandoned, and the like. Finally, a servicing wellbore operation may also include enhancing oil recovery operations such as injecting carbon dioxide into a reservoir to increase production by reducing oil viscosity and providing miscible or partially miscible displacement of the oil.

FIG. 1 illustrates an embodiment of the components involved in the wellbore servicing operation. These components may comprise a wellbore services manifold trailer 195, one or more blenders 110, one or more high-pressure pumps 142, and one or more wellheads 154. The wellbore services manifold trailer 195 is configured to couple to the blender 110 via blender connector 114 and flowline 112. The wellbore services manifold trailer 195 is configured to couple to the high-pressure pump 142 via high-pressure pump suction connector 138 and flowline 140, as well as via high-pressure pump discharge connector 146 and flowline 144. The wellbore services manifold trailer 195 is configured to couple to the wellhead 154 via wellhead connector 150 and flowline 152.

It is to be understood that there may be more than one components, connectors, flowlines, etc in the wellbore servicing operations. Thus, the illustration described herein should be treated as an example and may be modified according to the need of the wellbore servicing operations by a person of ordinary skill in the art.

In an embodiment, the blender 110 mixes solid and fluid components at a desired treatment rate to achieve a well-blended mixture (e.g., fracturing fluid, cement slurry, liquefied inert gas, etc.) at a first pressure. Examples of such fluids and solids include proppants, water, chemicals, cement, cement additives, or various combinations thereof. The mixing conditions including time period, agitation method, pressure, and temperature of the blender may be chosen by one of ordinary skill in the art to produce a homogeneous blend of the desired composition, density, and viscosity or to otherwise meet the needs of the desired wellbore servicing operations. The blender 110 may comprise a tank constructed from metal plate, composite materials, or any other material. In addition, the blender 110 may include a mixer or an agitator that mixes or agitates the components of fluid within the blender 110. The blender 110 may also be configured with heating or cooling devices to regulate the temperature within the blender 110. Alternatively, the fluid may be premixed and/or stored in a storage tank before entering the wellbore services manifold trailer. The blender 110 generally has an outlet pressure equal to or less than about 100 pounds per square inch (psi). For example, the blender 110 may have a pressure from about 10 psi to about 80 psi, from about 20 psi to about 60 psi, or from about 30 psi to about 50 psi.

Alternatively, the blender 110 may include a storage tank for an injection operation. Specifically, the blender 110 may store a fluid to be injected downhole. The fluid may comprise liquefied carbon dioxide, nitrogen, or any other liquefied inert gas.

Figure 2:
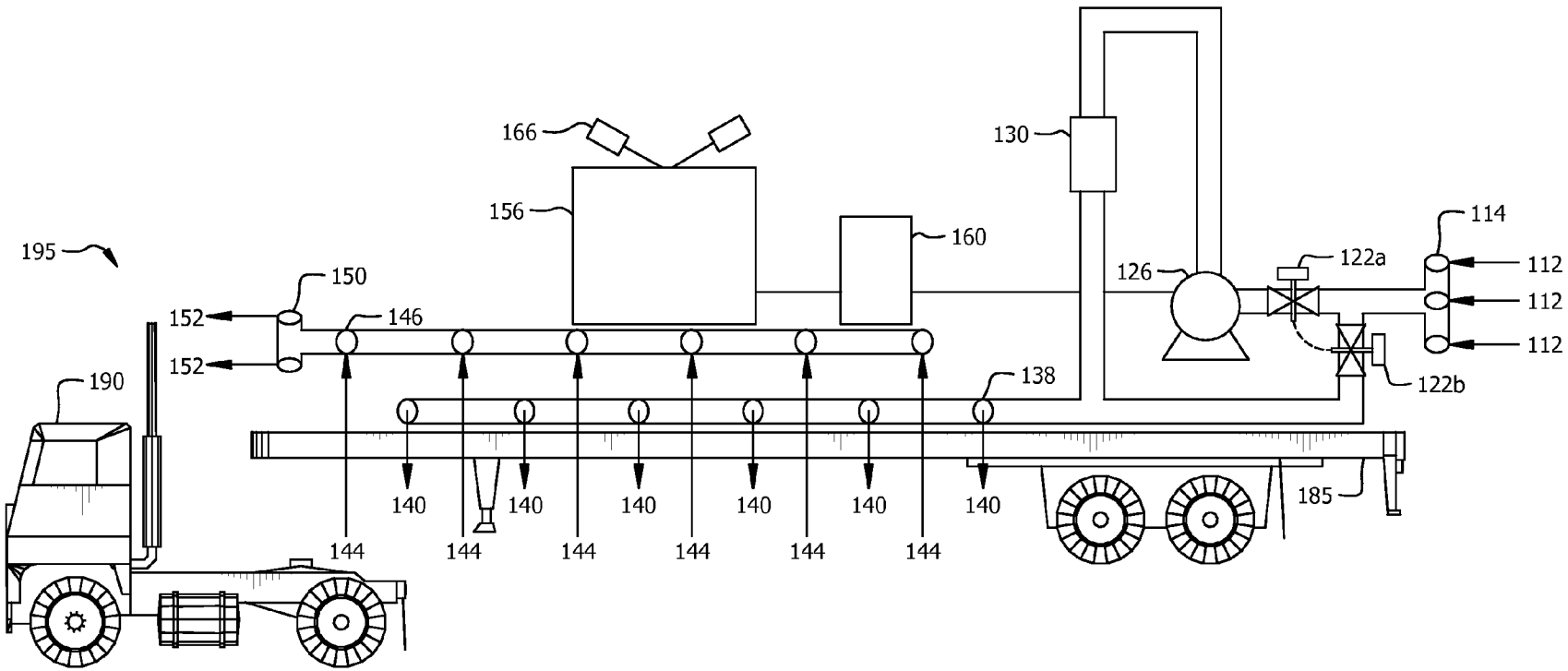
FIG. 2 is a side view of one embodiment of a wellbore services manifold trailer.

Finally, the blender may be configured to couple to the wellbore services manifold trailer 195 via blender connector 114 and flowline 112. There may be more than one blender connectors 114 in the wellbore services manifold trailer 195. For example, there may be three blender connectors 114 as illustrated in FIG. 2. In such case, there may be more than one blenders 110 connected to the wellbore services manifold trailer 195.

The wellbore services manifold trailer 195 may be a trailer (or truck) that is used to provide an increase in the inlet pressure for one or more high-pressure pumps by integrating a boost pump, to organize, and/or to distribute fluids to/from other components involved in the wellbore servicing operations such as the blender 110, the high-pressure pump 142, the wellhead 154, etc. After leaving the blender 110 at the first pressure via flowline 112, the fluid enters the wellbore services manifold trailer 195 via blender connector 114. From here, the fluid may enter a bypass valve assembly 122 (shown as a pair of valves 122*a* and 122*b*) via flowlines 116, 118, and 120. The fluid may be directed by the valve 122*a* to flow to the boost pump 126 via flowline 124 and then to a flowmeter 130 via flowline 128 and then to the high-pressure pump suction connector 138 via flowlines 132 and 136. Alternatively, the fluid may be directed by the valve 122*b* to bypass the boost pump 126 and the flowmeter 130 and directed to the high-pressure pump suction connector 138 via flowlines 134 and 136. In either case, the fluid may exit the wellbore services manifold trailer 195 via high-pressure pump suction connector 138 and enter the high-pressure pump 142 via flowline 140. The high-pressure pump 142 may increase the fluid's pressure to a high-pressure suitable for injection into the wellbore. The fluid may leave the high-pressure pump 142 via flowline 144, and enter the wellbore services manifold trailer 195 via high-pressure pump discharge connector 146. The fluid may be directed in the wellbore services manifold trailer via flowline 148 and exit the wellbore services manifold trailer 195 via wellhead connector 150 and enter the wellhead 154 via flowline 152.

The blender connector 114 carries the fluid to the bypass valve assembly 122 that may be a pair of valves 122*a* and 122*b* (as shown in FIG. 1) via flowlines 116, 118, and 120. In embodiments, the bypass valve assembly 122 may be a pair of bypass valves or a three-port valve. The bypass valve assembly 122 may be configured in two positions. In the first position where the valve 122*a* is open and 122*b* is closed, the valve 122*a* may allow fluid flow between the blender connector 114 and the boost pump 126 (via flowlines 116, 118, 124), and prohibit fluid flow between the blender connector 114 and the high-pressure pump suction connector 138 (via flowlines 116, 120, 134, 136). In the second position where the valve 122*a* is closed and 122*b* is open, the valve 122*b* may allow fluid flow between the blender connector 114 and the high-pressure pump suction connector 138 (via flowlines 116, 120, 134, 136), and prohibit fluid flow between the blender connector 114 and the boost pump 126 (via flowlines 116, 118, 124). The bypass valve assembly 122 may be a spring actuated bypass valve or a hand-actuated valve that is opened or closed by an operator. The bypass valve assembly 122 may comprise an actuator connected to a panel or a mechanism that coordinates the opening or closing of the bypass valve assembly 122.

After leaving the bypass valve assembly 122, the fluid enters the boost pump 126 via flowline 124. The boost pump 126 increases the pressure of the fluid to a second pressure greater than the first pressure received from the blender 110. The boost pump 126 may be any type of pump, for example a centrifugal pump. Centrifugal pumps may be preferred because they operate efficiently in high-volume and low to medium pressure conditions. In addition, the flow from the centrifugal pumps can be easily controlled, even allowing flow to be completely closed off while the centrifugal pump is running. An example of suitable boost pump is a commercially available Mission Sandmaster 10×8 centrifugal pump or an API 610 centrifugal pump. In an embodiment, the centrifugal pump may have an outlet pressure equal to or greater than about 60 psi, from about 80 psi to about 100 psi, or about 90 psi. When the centrifugal pump is used to pump an inert compressed or liquefied gas, the centrifugal pump may have a pressure equal to or greater than about 200 psi, from about 200 psi to about 600 psi, or from about 300 psi to about 500 psi. In such case, some components (i.e. connectors, etc) may be modified to meet the need for the inert compressed or liquefied gas.

The boost pump 126 may be powered by a power source 156. In an embodiment, the power source 156 may be a diesel engine. An example of suitable diesel engine includes a commercially available 520 hp Caterpillar C13. The power source 156 may be configured to control the boost pump 126 using a hydraulic control system 160. An example of such configuration is shown in FIG. 1 where the power source is coupled to the hydraulic control system 160 via flowline 158 and the hydraulic control system 160 is coupled to the boost pump 126 via flowline 162. An example of suitable hydraulic control system includes a hydrostatic transmission system comprising a Sundstrand variable displacement axial piston hydraulic pump with electric displacement control, a Volvo Hydraulics fixed displacement motor, a Barnes hydraulic gear pump, hydraulic components (e.g., oil reservoirs, oil coolers, hoses, and fittings), a pressure transducer to monitor pressure and a computer and software. The computer may send an electric signal to the Sundstrand variable displacement axial piston hydraulic pump to change the amount of hydraulic oil pumped, thus causing a flow rate or a pressure change of the Volvo Hydraulics fixed displacement motor and boost pump 126. The hydraulic control system may also be used to actuate the bypass valve assembly 122, if desired.

The power source 156 may illuminate an area substantially adjacent to the wellbore services manifold trailer 195 using a plurality of lights 166 via electrical wiring 164. An example of suitable light includes a 150-Watt Xenon light source. The power source 156 may also be used to power other equipments around the wellbore services manifold trailer 195 requiring power that may be useful to and/or appreciated by one skilled in the art.

After leaving the boost pump 126, the fluid enters the flowmeter 130 via flowline 128, which may measure a velocity of the fluid. Flowmeter 130 is available in various configurations such as piston meter, woltmann meter, venturi meter, orifice plate, pitot tube, paddle wheel, turbine flowmeter, vortex meter, magnetic meter, ultrasound meter, coriolis, differential-pressure meter, multiphase meter, spinner flowmeter, torque flowmeter, and crossrelation flowmeter. The orientation of the flowmeter 130 may be substantially horizontal or alternatively substantially vertical. FIG. 2 illustrates the flowmeter 130 in a substantially vertical orientation, which minimizes any clogging of the fluid in the flowmeter 130.

The fluid may leave the wellbore services manifold trailer 195 via one or more high-pressure pump suction connectors 138 and may enter one or more high-pressure pumps 142 via flowline 140. An example is illustrated in FIG. 2 where the wellbore services manifold trailer 195 with six high-pressure pump suction connectors 138 which can be configured to couple to six high-pressure pumps 142. The high-pressure pump 142 is generally a positive displacement pump. An example of suitable positive displacement pump includes a Halliburton HT-400™ Pump The high-pressure pump 142 increases the pressure of the fluid to a third pressure greater than the second pressure. For example, the high-pressure pump 142 may have a pressure equal to or greater than about 2,000 psi, from about 5,000 psi to about 20,000 psi, or from about 8,000 psi to about 12,000 psi. An increase in the fluid's pressure may result to an increase in the fluid's velocity, which may translate to an increase in productivity. In an embodiment, the high-pressure pump or pumps 142 may produce a total fluid flow rate of equal to or greater than about 50 barrel/minute (bbl/minute), greater than about 100 bbl/minute, or greater than about 120 bbl/minute.

Referring to FIG. 1, the fluid may then leave the high-pressure pump 142 via flowline 144 and enter the wellbore services manifold trailer 195 via high-pressure pump discharge connector 146. As described above, there may be one or more high-pressure pump discharge connectors 146 in a wellbore services manifold trailer. An example is illustrated in FIG. 2 where the wellbore services manifold trailer 195 has six high-pressure pump discharge connectors 146. Referring back to FIG. 1, the fluid may be distributed via flowline 148 in the wellbore services manifold trailer 195 and then directed to leave the wellbore services manifold trailer 195 via wellhead connector 150. After leaving the wellbore services manifold trailer 195, the fluid may enter the wellhead 154 via flowline 152. The wellhead 154 directs the fluid downhole into the wellbore.

Persons of ordinary skill in the art will appreciate that the connectors described herein are piping that are connected together for example via flanges, collars, welds, etc. These connectors may include various configurations of pipe tees, elbows, and related connectors. These connectors connect together the various wellbore servicing fluid process equipment described herein.

The wellbore services manifold trailer 195 may be used for injection operations where a fluid, such as liquefied carbon dioxide, liquefied nitrogen, or other liquefied inert gas, is injected downhole. For such operations, the wellbore services manifold trailer 195 may further comprise auxiliary components useful for pumping the liquefied inert gas such as a vapor/liquid separator. The vapor/liquid separator separates the vapor portion of the liquefied inert gas to prevent cavitation of the boost pump 126 and the high pressure pumps 142.

In operation, the wellbore services manifold trailer 195 is generally first transported to the well site for example for fracturing operations to treat a wellbore. FIG. 2 is an example that illustrates the placement of the components on the wellbore services manifold trailer 195 listed above. Referring to FIG. 2, once the wellbore services manifold trailer 195 arrived and positioned in a desired place, a tractor or prime mover 190 may be disconnected from a trailer bed 185. Next, the power source 156 is turned on. In addition, the plurality of lights 166 may be turned on if light if desired. Many times, fracturing operations may run at night and there may be trip hazards near and/or on the wellbore services manifold trailer 195 during these operations, for example on the walkways, on the trailer bed, in between piping, in an area near the power source 156, etc. Thus, the plurality of lights 166 may illuminate the area adjacent to the wellbore services manifold trailer 195 to improve working conditions and reduce trip hazards.

Next, the connectors on the wellbore services manifold trailer 195 are connected to their corresponding equipments. For example, referring to FIG. 2, the blender connectors 114, which may be located towards the back end near the axle of the trailer bed 185, are connected to the blenders 110. The high-pressure pump suction connectors 138, which may be located along the sides of the trailer bed 185 and arrange in parallel to each other, are connected the high-pressure pumps 142, and the high-pressure pumps 142 are then connected to the high-pressure pump discharge connectors 146, which may be located along the sides of the trailer bed 185 and arranged in parallel as well as shown in FIG. 2.

Fluids for fracturing operations are then added to the blenders 110 and the blenders 110 mix the fluids to achieve well-blended mixtures at a first pressure. The fluids may be sent from the blenders 110 to the wellbore services manifold trailer 195 to increase its pressure by opening the valve 122*a* and closing the valve 122*b*. The fluids may then enter the boost pump 126 where the fluid's pressure is increased to a second pressure higher than the first pressure. The fluid may be prepared as needed by the process to enter the flowmeter 130, for example by having an overhead piping such as shown in FIG. 2. Finally, the fluid may enter the flowmeter 130 that measures the fluid's velocity. The orientation of the flowmeter 130 may be substantially vertical to minimize clogging of the fluid, which may stop the flowmeter 130 from running. The fluids may then be fed to one or more high-pressure pumps 142 via one or more high-pressure pump suction connectors 138. For example, FIG. 2 illustrates the trailer bed 185 with six high-pressure pump suction connectors 138. The high-pressure pumps 142 may increase the fluid's pressure to a third pressure and send the fluid back to the wellbore services manifold trailer 195 via one or more high-pressure pump discharge connectors 146. Similarly, FIG. 2 illustrates the trailer bed 185 with six high-pressure pump discharge connectors 146. The wellbore services manifold trailer 195 may receive the fluid and feed the fluid to the wellhead 154 at the third pressure via one or more wellhead connectors 150 where the wellhead 154 feed the fluid downhole. There may be more than one wellhead connectors 150; for example, FIG. 2 illustrates the wellbore services manifold trailer 195 with two wellhead connectors 150. The wellhead connectors 150 may be located on the wellbore services manifold trailer 195 at the opposite end of the blender connector 114 as shown in FIG. 2. Finally, fluids may flow downhole to treat the formation in accordance with fracturing operations requirements.

In an embodiment, the fluids may be introduced to the wellbore to prevent the loss of aqueous or non-aqueous drilling fluids into lost-circulation zones such as voids, vugular zones, and natural or induced fractures while drilling. For example, the fluids may be placed into a wellbore as a single stream and activated by downhole conditions to form a barrier that substantially seals lost circulation zones. In such an embodiment, the fluids may be placed downhole through the drill bit, and form a composition that substantially eliminates the lost circulation. Specific methods for introducing compositions into a wellbore to seal subterranean zones are described in U.S. Pat. Nos. 5,913,364; 6,167,967; and 6,258,757, each of which is incorporated by reference herein in its entirety.

In an embodiment, the fluids may form a non-flowing, intact mass with good strength and may be capable of withstanding the hydrostatic pressure inside the lost-circulation zone. The fluids may plug the zone and inhibit the loss of subsequently pumped drilling fluid, thus allowing for further drilling. In some cases, it may be desirable to hasten the viscosification reaction for swift plugging of the voids. Alternatively, it may be desirable to prolong or delay the viscosification for deeper penetration into the voids. For example, the fluids may form a mass that plugs the zone at elevated temperatures, such as those found at higher depths within a wellbore.

In an embodiment, the fluids may be employed in well completion operations such as primary and secondary cementing operations. For example, the fluids may be placed into an annulus of the wellbore and allowed to set such that they isolate the subterranean formation from a different portion of the wellbore. The fluids may thus form a barrier that prevents other fluids in the subterranean formation from migrating into other subterranean formations. Within the annulus, the fluids also support a conduit, e.g., casing, in the wellbore. In an embodiment, the wellbore in which the fluids are positioned belongs to a multilateral wellbore configuration. It is to be understood that a multilateral wellbore configuration includes at least two principal wellbores connected by one or more ancillary wellbores.

In secondary cementing, often referred to as squeeze cementing, the fluids may be strategically positioned in the wellbore to plug a void or crack in the conduit, to plug a void or crack in the hardened sealant (e.g., cement sheath) residing in the annulus, to plug a relatively small opening known as a microannulus between the hardened sealant and the conduit, and so forth. Various procedures that may be followed to use a sealant composition in a wellbore are described in U.S. Pat. Nos. 5,346,012 and 5,588,488, which are incorporated by reference herein in their entirety.

Figure 3:
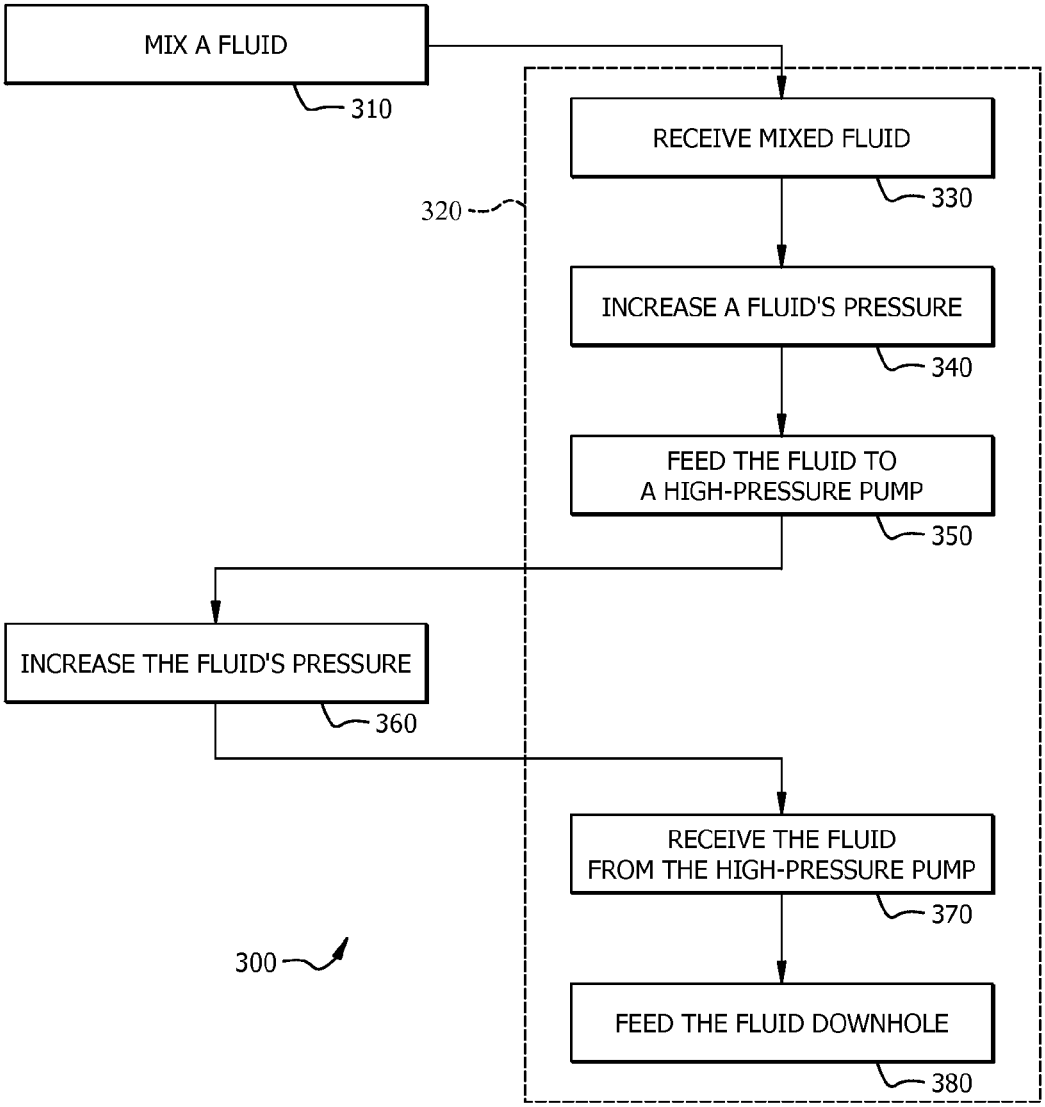
FIG. 3 is a flowchart of one embodiment of a wellbore servicing method.

FIG. 3 is a flowchart of an embodiment for using a wellbore servicing method 300. The wellbore servicing method 300 may include mixing a fluid at 310, receiving mixed fluid at 330, increasing the fluid's pressure at 340, feeding the fluid to a high-pressure pump at 350, increasing the fluid's pressure at 360, receiving the fluid from the high-pressure pump at 370, and feeding the fluid downhole at 380. Blocks 330, 340, 350, 370, and 380 may be performed by a single device 320, such as the wellbore services manifold trailer described above.

The advantages described herein maybe achieved by integrating the boost pump 126 with the wellbore services manifold trailer 195 to provide sufficient boost pressure for the high-pressure pump 142. Alternatively, the boost pressure may be provided by placing a centrifugal pump on the blender 110 unit, on the high-pressure pump 142 unit, on a separate typically smaller boost pump trailer, or by slowing down the high-pressure pump 142 to lower the minimum required pressure supply to prevent cavitation of the high-pressure pump 142. However, the integration of the boost pump 126 into the wellbore services manifold trailer 195 decreases or eliminates the need for additional separate boost pump trailer, the space consumed by the separate boost pump trailer, the additional cables and hookups required to connect, and the amount of personnel required to transport the separate trailer and to hookup the connections. Additionally, the integration of the boost pump 126 into the wellbore services manifold trailer 195 also maximizes the usage of horsepower in the blender 110 unit for mixing or in the high-pressure pump 142 unit for increasing fluid's pressure to a high-pressure instead of for providing sufficient boost pressure to the high-pressure pump 142. Furthermore, the integration of the boost pump 126 into the wellbore services manifold trailer 195 also maximizes the usage of the high-pressure pump 142 by operating it at a maximum capacity instead of having to slow down to prevent cavitation of the high-pressure pump because of insufficient boost pressure.

In embodiments described herein, there may be advantages related to the integration of a power source 156 into the wellbore services manifold trailer 195 as well. In an embodiment, the power source 156 may be use to power the boost pump 126, the hydraulic control system 160 which may control the boost pump 126. In yet another embodiment, the power source 156 may be use to power other equipments such as lights 166 to illuminate an area substantially adjacent to the wellbore services manifold trailer 195 and provide a safer working environment since some jobs may be carried out during dark.

While various embodiments have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims that follow, that scope including all equivalents of the subject matter of the claims. Each and every claim is incorporated into the specification as an embodiment of the present invention. Thus, the claims are a further description and are an addition to the embodiments of the present disclosure. The discussion of a reference in the disclosure is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A wellbore servicing method comprising:

transporting a wellbore servicing manifold trailer to a well site to be serviced, wherein the wellbore servicing manifold trailer comprises:

a blender connector configured to couple to a blender;

a boost pump coupled to the blender connector;

a high-pressure pump suction connector coupled to the boost pump and configured to couple to a high-pressure pump;

a flowmeter coupled to the boost pump and the high-pressure pump suction connector;

a high-pressure pump discharge connector configured to couple to the high-pressure pump; and a wellhead connector configured to couple to a wellhead;

connecting the blender connector to the blender;

connecting the high-pressure pump suction connector to the high-pressure pump;

connecting the high-pressure pump discharge connector to the high-pressure pump;

connecting the wellhead connector to the wellhead;

adding a fluid to the blender;

mixing the fluid;

sending the fluid from the blender at a first pressure to the wellbore servicing manifold trailer;

pressuring the fluid to a second pressure higher than the first pressure using the boost pump;

measuring a fluid flow with the flowmeter and adjusting a flow rate of the boost pump or the second pressure of the boost pump based on the fluid flow;

sending the fluid from the wellbore servicing manifold trailer to the high-pressure pump;

pressuring the fluid to a third pressure higher than the second pressure using the high-pressure pump;

sending the fluid from the high-pressure pump to the wellbore servicing manifold trailer; and sending the fluid from the wellbore servicing manifold trailer to the wellhead.

2. The method of claim 1, wherein the boost pump is a centrifugal pump.

3. The method of claim 1, wherein the high-pressure pump is a positive displacement pump.

4. The method of claim 1, wherein the first pressure is equal to or less than about 100 psi, wherein the second pressure is equal to or greater than about 60 psi, and wherein the third pressure is equal to or greater than about 2,000 psi.

5. The method of claim 1, wherein the first pressure is equal to or less than about 60 psi, wherein the second pressure is equal to or greater than about 80 psi, and wherein the third pressure is equal to or greater than about 10,000 psi.

6. The method of claim 1, wherein the wellbore servicing manifold trailer further comprises:

a bypass valve assembly coupled to the blender connector, the boost pump, and the high-pressure pump suction connector, wherein the bypass valve assembly is configured to allow fluid flow between the blender connector and the boost pump and prohibit fluid flow between the blender connector and the high-pressure pump suction connector in a first position, and wherein the bypass valve assembly is configured to allow fluid flow between the blender connector and high-pressure pump suction connector and prohibit fluid flow between the blender connector and the boost pump in a second position.

7. The method of claim 1, wherein the orientation of the flowmeter is substantially vertical.

8. The method of claim 1, wherein the wellbore servicing manifold trailer further comprises a power source for generating power for the boost pump.

9. The method of claim 8, wherein the wellbore servicing manifold trailer further comprising a hydraulic control system coupled to the power source and the boost pump.

10. The method of claim 9, further comprising controlling the flow rate of the boost pump or the second pressure of the boost pump using the hydraulic control system.

11. The method of claim 10, wherein the flow rate of the boost pump or the second pressure of the boost pump is controlled to substantially reduce or eliminate cavitation of the high-pressure pump.

12. The method of claim 8, wherein wellbore servicing manifold trailer further comprising a plurality of lights powered by the power source.

13. The method of claim 1, wherein the pressuring the fluid to the second pressure higher than the first pressure using the boost pump substantially reduces or eliminates cavitation of the high-pressure pump.

14. The method of claim 1, wherein the fluid comprises proppants, water, chemicals, or combinations thereof.

15. The method of claim 1, wherein the fluid comprises liquefied carbon dioxide, liquefied nitrogen, or other liquefied inert gas.

16. The method of claim 1, wherein the wellbore servicing manifold trailer further comprising a vapor/liquid separator upstream from the boost pump to remove vapor from the fluid prior to entering the boost pump.

17. The method of claim 1, wherein the wellbore servicing manifold trailer further comprises:

a plurality of high-pressure pump suction connectors coupled to the boost pump and configured to couple to a corresponding plurality of high-pressure pumps; and a plurality of high-pressure pump discharge connectors configured to couple to the plurality of high-pressure pumps.

18. The method of claim 1, wherein the wellbore servicing manifold trailer further comprises a plurality of wellhead connectors configured to couple to the wellhead.

19. The method of claim 1, wherein the fluid added to the blender at a supply pressure, and wherein mixing the fluid comprises raising the pressure of the fluid from the supply pressure to the first pressure.

* * * * *